United States Patent [19]

Reider

[11] 4,122,670

[45] Oct. 31, 1978

[54] PARALLEL STAGE FUEL COMBUSTION SYSTEM

[75] Inventor: Samuel B. Reider, Indianapolis, Ind.

[73] Assignee: General Motors Corporation, Detroit, Mich.

[21] Appl. No.: 765,846

[22] Filed: Feb. 4, 1977

[51] Int. Cl.[2] ..... F02C 7/22

[52] U.S. Cl. ..... 60/39.65; 60/39.74 R; 431/352; 431/353

[58] Field of Search ..... 60/39.65, 39.74 R, 39.74 B; 431/351-353

[56] References Cited

U.S. PATENT DOCUMENTS

| | | | |
|---|---|---|---|
| 2,954,003 | 11/1960 | Carlisle et al. | 60/39.74 B |
| 2,959,006 | 11/1960 | Ferrie | 60/39.74 R |
| 3,134,229 | 5/1964 | Johnson | 60/39.74 R |
| 3,973,395 | 8/1976 | Markowski | 60/39.65 |

*Primary Examiner*—Robert E. Garrett

*Attorney, Agent, or Firm*—J. C. Evans

[57] ABSTRACT

Combustion apparatus for a gas turbine engine includes two separate combustion zones; one having a first air flow thereto defined by a plurality of holes in combustion apparatus liner; the second zone has air flow thereto through a second plurality of holes in the combustion apparatus liner. Parallel fuel injectors supply fuel into the respective zones and include a wide angle fuel flow nozzle that supplies fuel to the pilot zone of combustion and a narrow cone fuel injector that directs fuel through the pilot zone without combustion and into a downstream main combustion region where the fuel is then burned with air flow though the second plurality of holes to produce a staged combustion of air fuel in the combustion apparatus to achieve high combustion efficiency over a broad ange of fuel/air ratios as well as more uniform combustor outlet temperatures and low smoke output.

3 Claims, 4 Drawing Figures

PARALLEL STAGE FUEL COMBUSTION SYSTEM

The invention herein described was made in the course of work under a contract or subcontract thereunder with the Department of Defense.

In gas turbine engines, high temperatures in combustor apparatus having a single combustor reaction zone reduces the operating limit of the apparatus. This is caused by a lean fuel blow-out characteristic when such engines are set at low power, idle fuel flow conditions.

It is recognized that combustion limits can be extended in high temperature rise combustor apparatus by incorporating a pilot fuel injector. In such apparatus two separate combustion zones are utilized to provide flow rates in volumes for optimum performance at the extreme operating ranges of idle and maximum power settings. One zone typically is located upstream in the combustion apparatus and for purposes of this specification will be referred to as a pilot zone. The pilot zone maintains conditions conducive to high altitude ignition at low inlet pressure and low inlet temperatures.

The stability of combustion apparatus operation at given inlet conditions of air and fuel also is controlled by air velocity and combustion volume. By using a separate upstream combustion volume, the combustion process can be precisely controlled by regulation of the air flow and fuel flow for optimum performance through a wide range of conditions from engine idle to full power control settings.

The concept of multi-zone combustion in combustion apparatus is recognized. For example, U.S. Pat. No. 2,959,006 issued Nov. 8, 1960 to F.G.M. Ferrie discloses multiple, parallel arranged fuel nozzles including a pilot nozzle and main fuel nozzles. However fuel from the main fuel nozzles is separated from combustion flow in the pilot or upstream zone of combustion in the apparatus by the provision of deflectors and tubes for directing the main fuel flow from the vicinity of the pilot zone to a manifold for distributing the main fuel flow into a downstream combustion zone.

Location of such deflectors and tubes within the combustion zones increases pressure drop across the combustion apparatus and furthermore serves as a component part of the combustion apparatus that must be replaced on a predetermined maintenance schedule.

An object of the present invention is to provide an improved, parallel staged combustor apparatus that utilizes air blast fuel injections located on a single combustor head plate and wherein at least one of the fuel supplying nozzles includes a narrow angle fuel spray cone to delay combustion of fuel therefrom until the fuel enters a downstream main combustion zone having a separate air supply thereto which is matched to the main fuel flow to achieve high combustion efficiency.

Another object of the present invention is to provide an improved parallel staged fuel combustion apparatus including a combustor having a first plurality of air openings thereto into an upstream pilot zone and a second plurality of air holes therethrough into a main combustion zone downstream of the first zone and wherein the combustion apparatus includes a head plate having first and second fuel injection nozzles thereon one for supplying pilot fuel directly into the upstream pilot zone for combustion with air flow thereto; and further including a parallel arranged, main fuel nozzle having a narrow cone fuel angle therefrom that will direct fuel through the upstream pilot zone with minimum combustion and into the downstream main combustion zone where the fuel will then combust with air flow through the main air holes and wherein the staged combustion in the pilot zone and downstream main combustion zone is accomplished with a high degree of combustion efficiency.

Yet another object of the present invention is to provide an improved combustion apparatus configuration for use in annular combustion configurations having an inner annular wall and an outer annular wall joined together by a single circumferentially formed combustor head plate and wherein the head plate supports a plurality of circumferentially spaced nozzle devices arranged in parallel by the provision of a first plurality of air flow holes in the outer wall for directing pilot air to a pilot combustion zone immediately downstream of the head plate and wherein the outer liner further includes a second plurality of air holes therein for directing a separate quantity of main combustion air into a combustion zone downstream of the pilot zone; and wherein a predetermined number of the nozzle devices are configured to produce a fuel flow as a wide angled cone directly into the pilot zone for combustion with air flow through the first plurality of holes and wherein other of the nozzles are configured to produce a flow of fuel as a narrow angled cone which will delay a flammable air fuel mixture of fuel within the narrow angled cone until the fuel is directed into the downstream combustion zone where the narrow cone widens to produce a flammable mixture with air flow through the second plurality of holes.

Further objects and advantages of the present invention will be apparent from the following description, reference being had to the accompanying drawings wherein a preferred embodiment of the present invention is clearly shown.

Figure 1:
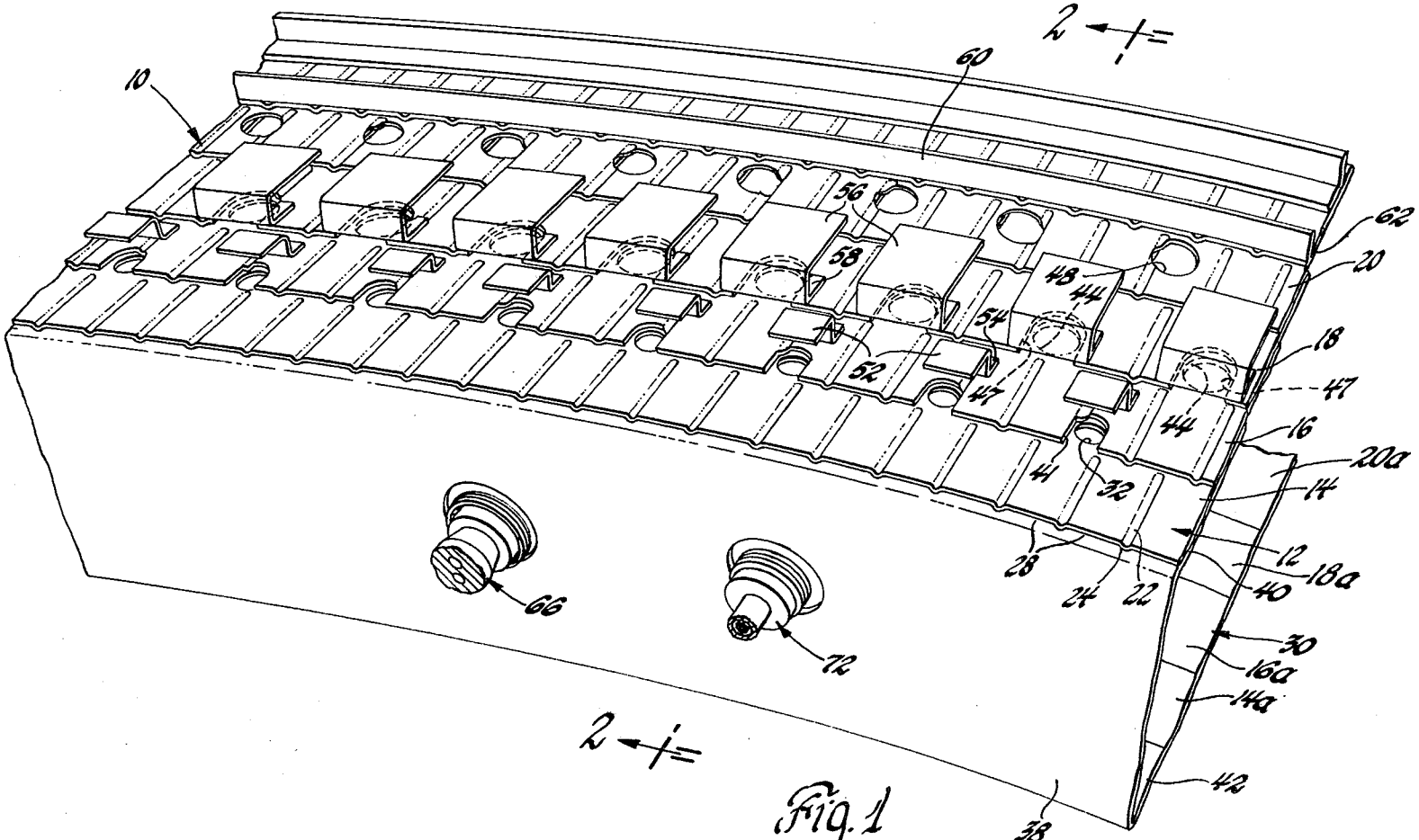
FIG. 1 is a fragmentary, arcuate segment of a combustion apparatus including the present invention.
Figure 2:
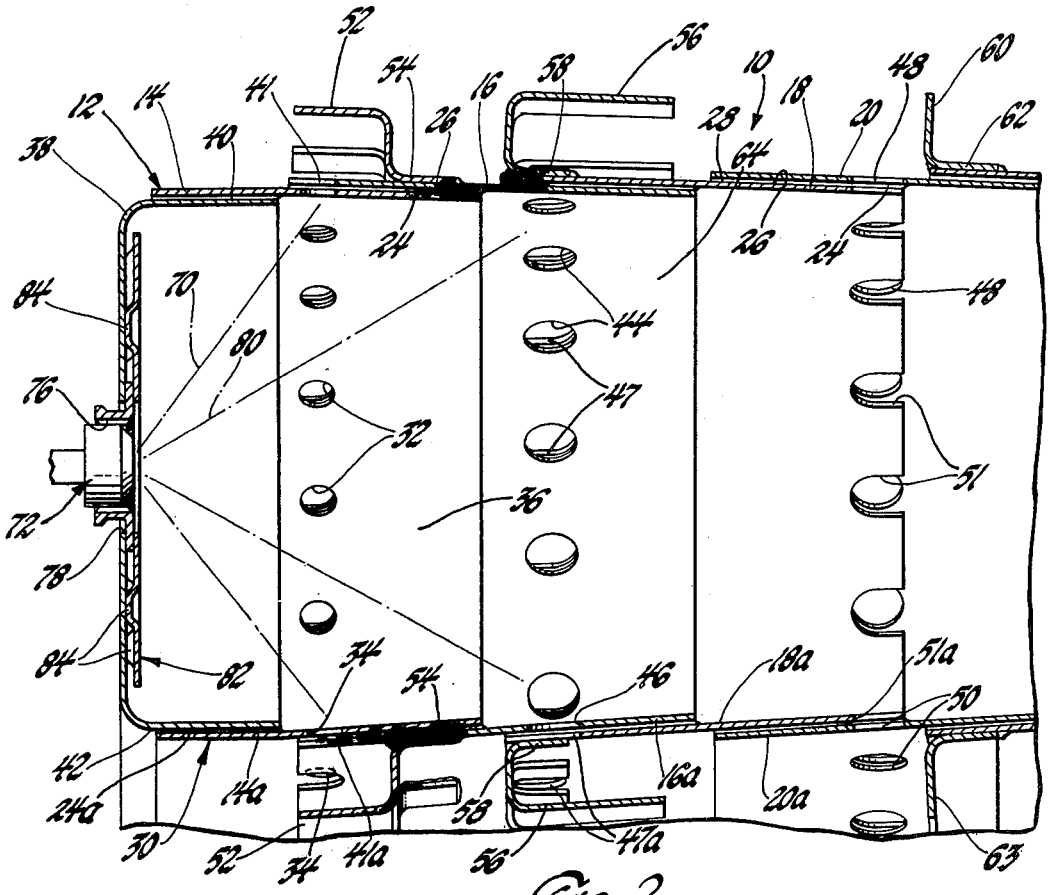
FIG. 2 is a fragmentary cross sectional view taken along the line 2—2 of FIG. 1 looking in the direction of the arrows.

Referring now to FIGS. 1 and 2, a combustion apparatus 10 as illustrated, representatively shown as being of an annular configuration including an outer annular wall 12 made up of a plurality of axially spaced segments 14, 16, 18 and 20. Each of the axial segments 14 through 20 include circumferential spaced axial deformations 22 therein that form radially inwardly directed ribs 24 that contact a downstream outer surface segment 26 of an adjacent casing segment to define a passage 28 for flow of cooling air across the liner segments.

The apparatus further includes an inner annular wall 30 of like configuration.

The liner segment 14 and like liner segment 14*a* of the inner annular wall 30 have a plurality of holes 32, 34 respectively to direct a predetermined quantity of pilot air into an upstream pilot combustion zone 36. The combustion zone 36 is closed at one end by a continuously circumferentially formed combustor head plate 38 having an axially directed flange segment 40 with an outer surface thereon engaged by the ribs 24 on the casing segment 14. Relief to holes 32, 34 is provided by notches 41, 41a in segments 16, 16a respectively.

The headplate 38 further includes an inner annular flange 42 thereon having its inner surface in engagement with ribs 24a formed on the inner wall segment 14a.

In addition to the holes 32, 34 the combustion apparatus 10 includes a plurality of circumferentially arranged primary combustion air holes 44. More particularly, as best shown in FIG. 2, they are formed circumferentially around the outer annular wall segment 16. Likewise primary combustion air holes 46 are formed circumferentially around an inside annular wall segment 16a of the inner wall 30. Segment 18 has a plurality of end notches 47 that open to holes 44. Likewise segment 18a has a plurality of end notches 47a that open to holes 46.

The combustion apparatus also includes a plurality of circumferentially spaced, dilution air holes 48 in the annular wall segment 20 and a like plurality of circumferentially spaced dilution air holes 50 in the inner segments 20a of the inner wall 30. Segments 18, 18a are notched at 51 and 51a respectively to provide relief at overlap with segments 20, 20a.

Flange baffles 52 are located in overlying relationship with each of the holes 32, 34. More particularly each of the flange baffles 52 includes a base portion 54 welded to the outer surface of the segments 16, 16a axially downstream of the holes 32, 34 therethrough.

Additionally, a flange baffle 56 is located in overlying relationship to each of the primary combustion air holes 44, 46. Each of the baffles 56 includes a base 58 welded to the outer surface of the wall segments 18, 18a as best shown in FIG. 2. An outer annular flange 60 has its base 62 secured fixedly to liner segment 20 at a point axially downstream of the wall segment 20 and axially spaced downstream of each of the dilution airholes 48. A like inner annular flange 63 is attached to segment 20a at a like point.

The plurality of primary airholes 44, 46 supply air to an annular primary combustion zone 64 downstream of the pilot combustion zone 36. The dilution holes 48, 50 supply air to weaken the fuel/air ratio and thereby lower the temperature prior to exhaust of combustion products from the combustion apparatus 10.

The pilot combustion zone 36 and the downstream primary combustion zone 64 are supplied with a predetermined controlled amount of air into each of the zones as determined by area of the holes 37, 34 and 44, 46. A fuel supply system of parallel design matches fuel flow into each of the combustion zones 36, 64 to achieve maximized combustion efficiency over a broad range of fuel/air ratios as for example occurs between gas turbine engine operation from idle to full power control settings.

Figure 3:
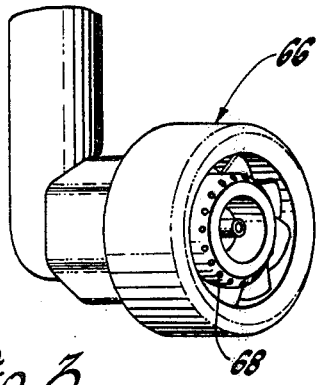
FIG. 3 is a view in perspective of a wide angle pilot fuel nozzle used in the combination of the present invention.
Figure 4:
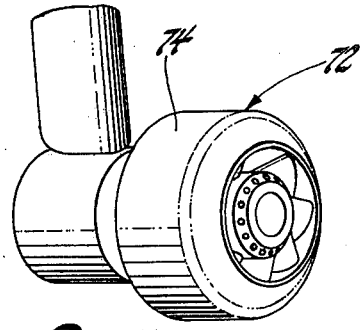
FIG. 4 is a view in perspective of a narrow angle main fuel nozzle in the combination of the present invention.

The initial pilot zone 36 is associated more particularly with a plurality of fuel nozzles 66 one of which is shown in FIG. 3. It includes a starting fuel tip and a pilot fuel tip 68 through which fuel flows to produce a wide angle fuel cone shown at 70 in FIG. 2 which will distribute pilot fuel into intimate relationship with air flow through the pilot combustion zone openings 32, 34 to provide a fuel/air mixture for high altitude ignition at low air inlet temperature and pressures. Stability of the pilot ignition under the wide range of inlet conditions is controlled by both the air velocity flow into and the volume of pilot combustion zone 36. By isolating the combustion volume to the annular space defined by the pilot combustion zone 36 pilot combustion process can be precisely controlled by the size of the pilot air holes 32, 34 and the fuel flow and air angle through the pilot fuel nozzle 66. The nozzle 66 is more particularly an air blast atomizer nozzle of the type supplied by Diesel Equipment Division of General Motors Corporation Identification No. X46015. During pilot combustion, fuel is directed through the nozzle tip 68 to produce the wide angle cone 70 and 40% of the rated fuel flow to the apparatus 10 is directed through the nozzle 66 along with directing 31.1% of the total air flow into the combustion apparatus through the pilot combustions holes 32, 34.

An equivalence ratio $\phi$ of approximately 1.3 is achieved by injecting the 31.1% of air into the pilot combustion zone 36 along with 40% of the rated fuel flow.

Additionally, the combustion apparatus includes a plurality of main air blast type fuel nozzles 72 manufactured by Diesel Equipment Division of General Motors Corporation Identification No. X-46020. Each nozzle 72 has an outer peripheral housing portion 74 seated within a support flange 76 secured within an opening 78 of the head plate 38.

Each nozzle 72 is supported in parallel with the nozzles 66 and the invention utilizes circumferential staging of operation of the nozzles 66, 72 for supplying fuel respectively to the pilot combustion zone 36 and the main combustion zone 64.

More particularly, each of the nozzles 72 has a narrow fuel cone 80 directed therefrom which is configured so that combustion within the cone 80 is delayed as it passes through the pilot combustion zone 36. At the point of the primary combustion zone 64 which has air supplied thereto through holes 44, 46, the spray cone 80 downstream of the fuel nozzle 72 is expanded and mixed with the primary air to the point where it becomes a flammable air fuel mixture for combustion in the zone 64. In one working embodiment 28% of air supplied to the combustion apparatus 10 is injected through the holes 44, 46 for combustion with 60% of the fuel which is directed through the narrow angle cones 80 from the primary fuel nozzles 72. The main combustion process is precisely controlled by the size of holes 44, 46 and the fuel flow and air angle through the primary fuel nozzles 72. In the same working embodiment of the invention dilution air of 24% of the total air flow to the combustion apparatus is directed through the holes 48, 50 to lower the temperature within the apparatus 10. A baffle sheet 82 overlies the inner surface of plate 38 around nozzles 66, 72 and is spaced therefrom by dimples 84 therein to cool the plate 38 to prevent burn-out.

While the embodiment of the present invention, as herein disclosed, constitutes a preferred form, it is to be understood that other forms might be adopted.

The embodiments of the invention in which an exclusive property or privilege is claimed are defined as follows:

1. A combustor assembly for a gas turbine engine, comprising a head plate, a combustor liner joined to said plate including an outer wall and an inner wall, a plurality of pilot air holes in said liner located a first predetermined distance downstream of said head plate to supply a first combustion zone within said liner, a plurality of main air holes in said liner located downstream of said pilot air holes to supply a second combustion zone within said liner, a first fuel injection nozzle supported on said head plate for directing a first narrow fuel spray cone of a predetermined included angle to maintain a non-flammable air/fuel mixture within said first combustion zone at said narrow fuel spray cone, said narrow fuel spray cone being dispersed at said second combustion zone to define a flammable air/fuel mixture, a second fuel injection nozzle supported on said head plate in parallel to said first nozzle and including means therein to produce a wide angle fuel cone for supplying a fuel dispersion into said first combustion zone for combustion with air flow through said pilot air holes prior to passage into said second combustion zone to prevent combustor flame blow-out under lean fuel-/air ratios.

2. An annular combustor assembly for a gas turbine engine, comprising an annular head plate, a combustor liner joined to said plate including an annular outer wall and an annular inner wall, a plurality of pilot air holes in said outer annular wall and said inner annular wall located a first predetermined distance downstream of said head plate to supply a first combustion zone within said liner, a plurality of main air holes in said outer and inner annular walls located downstream of said pilot air holes to supply a second combustion zone within said liner, a first narrow fuel injection nozzle supported on said plate for directing a first narrow fuel spray cone of a predetermined included angle to maintain a non-flammable air/fuel mixture within said first combustion zone at said narrow fuel spray cone, said narrow fuel spray cone being dispersed at said second combustion zone to define a flammable air/fuel mixture, a second fuel injection nozzle supported on said head plate in parallel to said first nozzle and including means therein to produce a wide angle fuel cone for supplying a fuel dispersion into said first combustion zone for combustion with air flow through said pilot air holes prior to passage into said second combustion zone to prevent combustor flame blow-out under lean fuel/air ratios.

3. An annular combustor assembly for use in a gas turbine engine comprising an outer annular wall having a plurality of axially spaced segments each including a radially inward formed deformation at one end thereof to form a spacer rib, each spacer rib on one of said axial segments being engageable with the outer surface of an adjacent segment to form a wall cooling passage, said combustor assembly including an inner annular wall, said inner annular wall having a plurality of axial segments each including an inward deformation therein engageable with an adjacent segment to form a wall cooling passage, means forming a first plurality of holes in said inner and outer walls in communication with a first combustion zone within said liner for directing pilot air therethrough, means forming a second plurality of holes in said inner and outer walls downstream of said first plurality of holes for directing air into a second downstream combustion zone within said combustor assembly, an annular head plate closing one end of said inner and outer annular walls, a first fuel injection nozzle on said head plate for directing a first narrow fuel spray cone into said first combustion zone, said first narrow fuel spray cone having a predetermined included angle to maintain a nonflammable air fuel mixture within said first combustion zone and said cone being dispersed in the region of said second combustion zone to define a flammable air fuel mixture to burn air and fuel within said second downstream combustion zone, a second fuel injection nozzle supported on said head plate in parallel to said first nozzle and including means therein to produce a wide angle fuel cone therefrom for supplying fuel dispersion into said first combustion zone for combustion with air flow through said first plurality of holes for burning of air fuel to prevent combustor flame blowout when the lean fuel air ratios are supplied to said first combustion zone.

* * * * *